US008083608B2

(12) United States Patent
Thomas et al.

(10) Patent No.: US 8,083,608 B2
(45) Date of Patent: Dec. 27, 2011

(54) ORIENTATION MARKER FOR GOLF CLUB HAVING RELEASABLE AND INTERCHANGEABLE HEAD AND SHAFT CONNECTIONS

(75) Inventors: James S. Thomas, Fort Worth, TX (US); Robert Lukasiewicz, Jr., Portland, OR (US)

(73) Assignee: Nike, Inc., Beaverton, OR (US)

( * ) Notice: Subject to any disclaimer, the term of this patent is extended or adjusted under 35 U.S.C. 154(b) by 0 days.

(21) Appl. No.: 13/008,134

(22) Filed: Jan. 18, 2011

(65) Prior Publication Data

US 2011/0111874 A1 May 12, 2011

Related U.S. Application Data

(62) Division of application No. 12/769,909, filed on Apr. 29, 2010, which is a division of application No. 12/193,619, filed on Aug. 18, 2008.

(51) Int. Cl.
*A63B 53/02* (2006.01)
*A63B 53/06* (2006.01)

(52) U.S. Cl. ..... 473/307; 473/246; 473/309

(58) Field of Classification Search ..... 473/245–248, 473/307, 309; 206/135.4; 150/160; 40/915
See application file for complete search history.

(56) References Cited

U.S. PATENT DOCUMENTS

| | | | |
|---|---|---|---|
| 2,027,452 | A | 5/1934 | Rusing |
| 2,067,556 | A | 1/1937 | Wettlaufer |
| 2,219,670 | A | 1/1939 | Wettlaufer |
| 2,326,495 | A | 8/1943 | Reenstierna |
| 2,361,415 | A | 10/1944 | Reach |
| 2,962,286 | A | 11/1956 | Browser |
| 3,595,577 | A | 7/1971 | Hodge |
| 3,625,517 | A | 12/1971 | Durnack |
| 3,810,631 | A | 5/1974 | Braly |
| 3,840,231 | A | 10/1974 | Moore |
| 4,222,567 | A | 9/1980 | Shabala |
| 4,948,132 | A | 8/1990 | Wharton |
| 5,058,891 | A | 10/1991 | Takeuchi |
| 6,110,055 | A | 8/2000 | Wilson |
| 6,183,375 | B1 | 2/2001 | Weiss |
| 6,241,623 | B1 | 6/2001 | Laibangyang |

(Continued)

FOREIGN PATENT DOCUMENTS

| | | | |
|---|---|---|---|
| WO | 9000424 | A1 | 1/1990 |
| WO | 2009032533 | A1 | 3/2009 |
| WO | 2010011510 | A1 | 1/2010 |

OTHER PUBLICATIONS

International Search Report mailed Mar. 23, 2010 for PCT/US2009/053513.

*Primary Examiner* — Stephen L. Blau
(74) *Attorney, Agent, or Firm* — Banner & Witcoff, Ltd.

(57) ABSTRACT

A golf club may have an orientation marker located on the golf club that indicates at least a relative orientation between the golf club head and shaft. The orientation marker may be located, for example, on the golf club head or shaft. A key member provides additional information with respect to the relative orientation between the golf club head and the shaft. The key member may be located, for example, on the golf club head, shaft, or grip portion, or on a head cover for the golf club head.

4 Claims, 15 Drawing Sheets

U.S. PATENT DOCUMENTS

| | | | |
|---|---|---|---|
| 6,341,690 | B1 | 1/2002 | Swiatosz |
| 6,890,269 | B2 | 5/2005 | Burrows |
| 2004/0018886 | A1 | 1/2004 | Burrows |
| 2005/0181884 | A1 | 8/2005 | Beach et al. |
| 2005/0282652 | A1 | 12/2005 | Brinton et al. |
| 2006/0163093 | A1 | 7/2006 | Kronenberger |
| 2008/0108455 | A1 | 5/2008 | Wu |
| 2010/0022323 | A1 | 1/2010 | Thomas et al. |

ORIENTATION MARKER FOR GOLF CLUB HAVING RELEASABLE AND INTERCHANGEABLE HEAD AND SHAFT CONNECTIONS

CROSS REFERENCE TO RELATED APPLICATION

This application is a division of U.S. application Ser. No. 12/769,909, filed Apr. 29, 2010, which is a division of U.S. application Ser. No. 12/193,619 filed Aug. 18, 2008, the disclosures of which are hereby incorporated by reference in their entirety.

BACKGROUND

Golf is enjoyed by a wide variety of players—players of different genders and dramatically different ages and/or skill levels. Golf is somewhat unique in the sporting world in that such diverse collections of players can play together in golf events, even in direct competition with one another (e.g., using handicapped scoring, different tee boxes, in team formats, etc.), and still enjoy the golf outing or competition. These factors, together with the increased availability of golf programming on television (e.g., golf tournaments, golf news, golf history, and/or other golf programming) and the rise of well known golf superstars, at least in part, have increased golf's popularity in recent years, both in the United States and across the world.

Golfers at all skill levels seek to improve their performance, lower their golf scores, and reach that next performance "level." Manufacturers of all types of golf equipment have responded to these demands, and in recent years, the industry has witnessed dramatic changes and improvements in golf equipment. For example, a wide range of different golf ball models now are available, with balls designed to complement specific swing speeds and/or other player characteristics or preferences, e.g., with some balls designed to fly farther and/or straighter; some designed to provide higher or flatter trajectories; some designed to provide more spin, control, and/or feel (particularly around the greens); some designed for faster or slower swing speeds; etc. A host of swing and/or teaching aids also are available on the market that promise to help lower one's golf scores.

Being the sole instrument that sets a golf ball in motion during play, golf clubs also have been the subject of much technological research and advancement in recent years. For example, the market has seen dramatic changes and improvements in putter designs, golf club head designs, shafts, and grips in recent years. Additionally, other technological advancements have been made in an effort to better match the various elements and/or characteristics of the golf club and characteristics of a golf ball to a particular user's swing features or characteristics (e.g., club fitting technology, ball launch angle measurement technology, ball spin rates, etc.).

Given the recent advances, there is a vast array of golf club component parts available to the golfer. For example, club heads are produced by a wide variety of manufacturers in a variety of different models. Moreover, the individual club head models may include multiple variations, such as variations in the loft angle, lie angle, offset features, weighting characteristics (e.g., draw biased club heads, fade biased club heads, neutrally weighted club heads, etc.). Additionally, the club heads may be combined with a variety of different shafts, e.g., from different manufacturers; having different stiffnesses, flex points, kick points, or other flexion characteristics, etc.; made from different materials; etc.). Between the available variations in shafts and club heads, there are literally hundreds of different club head/shaft combinations available to the golfer.

Club fitters and golf professionals can assist in fitting golfers with a golf club head/shaft combination that suits their swing characteristics and needs. Conventionally, however, golf club heads are permanently mounted to shafts using cements or adhesives. Therefore, to enable a golfer to test a variety of head/shaft combinations, the club fitter or professional must carry a wide selection of permanently mounted golf club head/shaft combinations (which takes up a considerable amount of storage space and inventory costs) or the club fitter or professional must build new clubs for the customer as the fitting process continues (which takes a substantial amount of time and inventory costs). The disadvantages associated with these conventional options serve to limit the choices available to the golfer during a fitting session and/or significantly increase the expense and length of a session.

SUMMARY

The following presents a general summary of aspects of the invention in order to provide a basic understanding of the invention and various features of it. This summary is not intended to limit the scope of the invention in any way, but it simply provides a general overview and context for the more detailed description that follows.

Aspects of this invention are directed to orientation markers for golf clubs of the type which have releasable and interchangeable head and shaft connections. The orientation marker provides information with respect to at least the relative orientation between the golf club head and shaft. A separate key member provides additional information with respect to the relative orientation between the golf club head and the shaft, such as a predicted effect on ball flight for a particular head/shaft orientation. The orientation marker may be located, for example, on the golf club head or shaft. The key member may be located, for example, on the golf club head, shaft, or grip portion, or on a head cover for the golf club head.

BRIEF DESCRIPTION OF THE DRAWINGS

A more complete understanding of the present invention and certain advantages thereof may be acquired by referring to the following detailed description in consideration with the accompanying drawings, in which.

Figure 1:
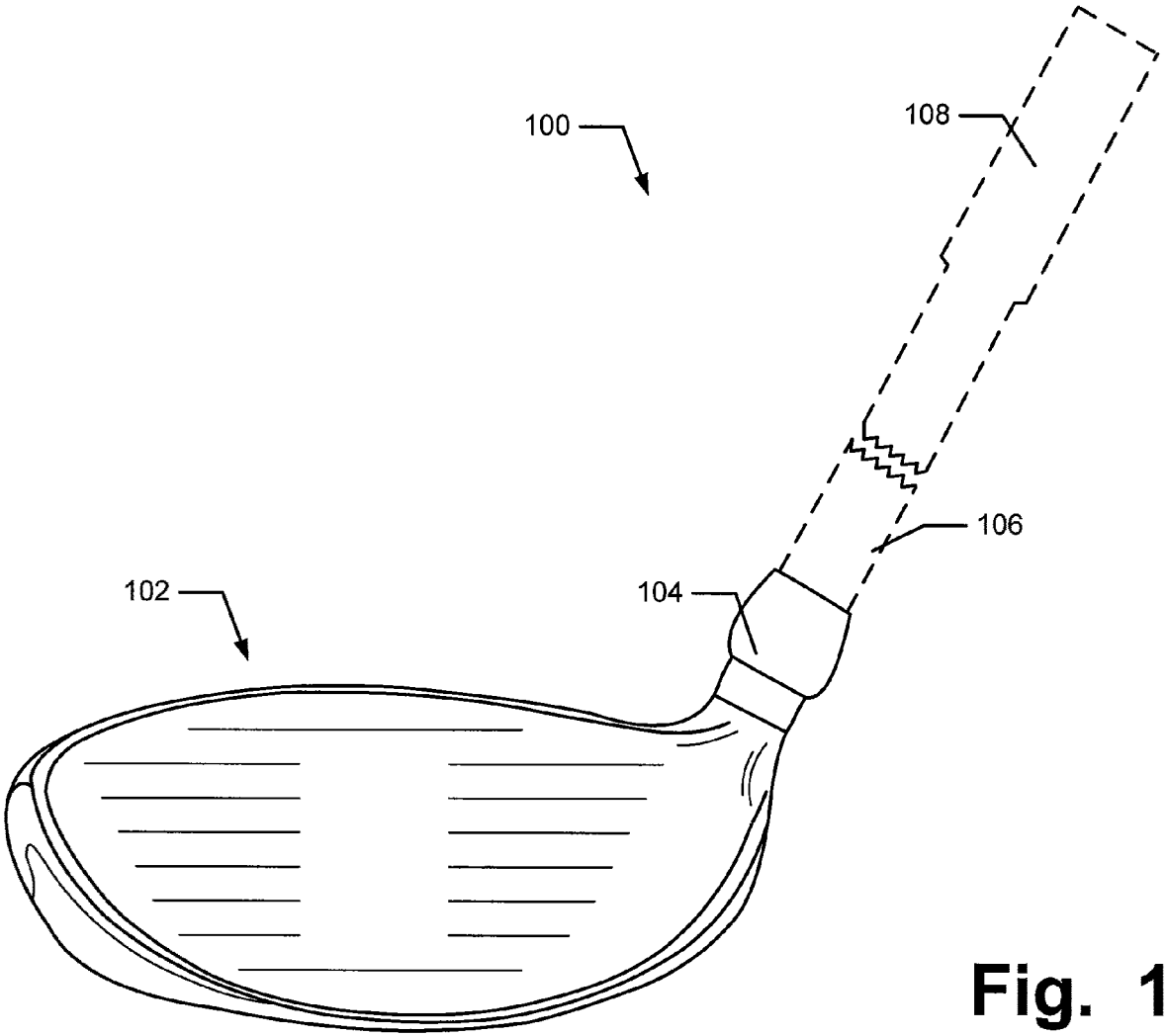
FIG. 1 generally illustrates a front view of an example golf club.

The reader is advised that the attached drawings are not necessarily drawn to scale.

DETAILED DESCRIPTION

In the following description of various example structures, reference is made to the accompanying drawings, which form a part hereof, and in which are shown by way of illustration various example connection assemblies, golf club heads, and golf club structures. Additionally, it is to be understood that other specific arrangements of parts and structures may be utilized, and structural and functional modifications may be made without departing from the scope of the present invention. Also, while the terms "top," "bottom," "front," "back," "rear," "side," "underside," "overhead," and the like may be used in this specification to describe various example features and elements of the invention, these terms are used herein as a matter of convenience, e.g., based on the example orientations shown in the figures and/or the orientations in typical use. Nothing in this specification should be construed as requiring a specific three dimensional or spatial orientation of structures.

A. General Description of Golf Club Head/Shaft Connection Assemblies and Golf Clubs Including Such Assemblies In general, as described above, the orientation marker may be used together with golf clubs of the type in which the club head and shaft are connected in a releasable manner so that the club head and shaft can be readily interchanged and/or repositioned with respect to one another, or which have other characteristics that may be alterable. Non-limiting examples of golf clubs of this type and methods of assembling the same are described in U.S. application Ser. No. 11/774,522, filed Jul. 6, 2007 and U.S. application Ser. No. 12/177,778, filed Jul. 22, 2008, the disclosures of which are hereby incorporated by reference in their entireties. Other non-limiting examples of golf clubs in which the club head is repositionable with respect to the shaft are shown in Wettlaufer U.S. Pat. No. 2,219,670 and Reenstierna U.S. Pat. No. 2,326,495, the disclosures of which are hereby incorporated by reference in their entireties.

1. Example Golf Club Head/Shaft Connection Assemblies and Golf Club Structures The golf club head/shaft connection assemblies may be adapted for securely but releasably connecting a golf club head and shaft. Such assemblies may include, for example: (a) a shaft engaging member including an opening providing access to a cylindrical interior chamber for receiving a golf club shaft and a rotation-inhibiting structure extending in an axial direction away from the opening and the cylindrical interior chamber; (b) a club head engaging member including an opening providing access to an interior chamber for releasably receiving (and holding) at least a portion of the shaft engaging member, wherein the interior chamber of the club head engaging member includes a retaining structure for engaging the rotation-inhibiting structure; and (c) a securing system for releasably securing the shaft engaging member with respect to the club head engaging member. The assemblies further may include a retaining element engaged with at least one of the shaft engaging member and the club head engaging member.

The rotation-inhibiting structure(s) of the shaft engaging member may take on a wide variety of forms in golf club head/shaft connection assemblies. In some example structures, the rotation-inhibiting structure will have a polygon cross section (e.g., a polygon having 18 or fewer sides, and in some examples, a polygon having 12 or fewer sides, 10 or fewer sides, eight or fewer sides, six or fewer sides, or even four or fewer sides), and it will fit into a retaining structure (e.g., an opening or chamber in the club head engaging member) having a size and shape adapted to inhibit rotation of the shaft engaging member with respect to the club head engaging member (e.g., having the same general polygon shape). In some more specific example structures, the rotation-inhibiting structure of the shaft engaging member will have a square or rectangular cross section and the retaining structure of the club head engaging member will include a square or rectangular shaped opening that receives the rotation-inhibiting structure.

The rotation-inhibiting structure of the shaft engaging member also may take on a variety of different sizes and constructions without departing from this invention. In some example structures, the shaft engaging member will be generally cylindrical with an open circular cylindrical chamber for receiving a golf club shaft. The rotation-inhibiting structure may extend beyond this open chamber in the general axial direction of the overall shaft engaging member structure. In some examples, the rotation-inhibiting structure of the shaft engaging member will extend less than 50% of an overall axial length of the shaft engaging member, and it may extend less than 35%, less than 25%, or even less than 15% of the overall axial length of the shaft engaging member. This feature can help keep the overall connection assembly relatively short, compact, and lightweight.

As a more specific example, golf club head/shaft connection assemblies may include: (a) a shaft engaging member having a first end and a second end, wherein the first end includes an opening providing access to a cylindrical interior chamber for receiving a golf club shaft, wherein an exterior surface of the first end includes an extending portion extending in a radial direction away from the cylindrical interior chamber, and wherein an exterior surface of the second end located beyond the cylindrical interior chamber includes a rotation-inhibiting structure; (b) a club head engaging member having a first end and a second end, wherein the first end of the club head engaging member includes an opening for releasably receiving the shaft engaging member, wherein the first end of the club head engaging member further includes a securing structure, and wherein an interior of the second end of the club head engaging member includes a rotation-inhibiting structure for engaging the rotation-inhibiting structure of the shaft engaging member; and (c) a securing member extending over the extending portion of the shaft engaging member and releasably engaging with the securing structure of the club head engaging member, wherein the securing member, at least in part, releasably secures the shaft engaging member with the club head engaging member. Such assemblies also may have one or more of the various more specific features or characteristics described above.

In some example golf club head/shaft connection assemblies, the second end of the club head engaging member further may include a portion extending beyond the rotation-inhibiting structure of the club head engaging member and the second end of the shaft engaging member may include a projection extending beyond its rotation-inhibiting structure (the projection may extend into the portion of the club head engaging member extending beyond its rotation-inhibiting structure). An additional retaining element may be provided, extending into the portion of the club head engaging member extending beyond its rotation-inhibiting structure, and this retaining element may engage the projection and/or the portion of the club head engaging member extending beyond its rotation-inhibiting structure. Alternatively, if desired, the retaining element may be integrally formed as a unitary structure with the club head engaging member.

The club head/shaft connection assemblies may include a golf club shaft engaged with the shaft engaging member and a club head body engaged with the club head engaging member. The shaft and club head engaging members then are engaged together (e.g., by sliding the shaft engaging member into the interior chamber defined by the club head engaging member and engaging their rotation-inhibiting structures together), and the overall assembly may be releasably secured together (e.g., by engaging a securing member with the club head engaging member and/or the shaft engaging member, or by another releasable mechanical fastener connection), as will be described in more detail below.

B. General Description of Position/Angle Adjustable Golf Club Head/Shaft Connection Assemblies and/or Golf Clubs Systems and methods for connecting golf club heads to shafts in a releasable manner enable the club heads and shafts to be readily interchanged and/or the position and/or angle of the club head (e.g., the ball striking face) with respect to the shaft to be readily adjusted. More detailed descriptions of these aspects follow.

1. Example Position/Angle Adjustable Golf Club Head/Shaft Connection Assemblies and/or Golf Club Structures Example golf club head/shaft connection assemblies may include: (a) a shaft engaging member including an exterior surface and an open first end that define an interior chamber for receiving a golf club shaft, wherein the exterior surface extends in a first axial direction and the interior chamber extends in a second axial direction that differs from the first axial direction; (b) a club head engaging member including an opening providing access to an interior chamber for releasably receiving at least a portion of the shaft engaging member; and (c) a system for preventing rotation of the shaft engaging member with respect to the club head engaging member. With such assemblies, the shaft position and/or angle with respect to the club head (and its ball striking face) may be adjusted by rotating the shaft engaging member with respect to the club head engaging member.

These club head/shaft connection assemblies may have any of the more detailed structures and/or features described above. Moreover, such assemblies may be included as part of golf club structures in the same manner described above.

As another example, golf club structures may include shafts having one or more bends or other axial direction changes in them. Such golf club structures may include: (a) a shaft including at least one shaft axial direction change region; (b) a shaft engaging member engaged with the shaft such that the shaft axial direction change region is located external to the shaft engaging member, wherein the shaft engaging member includes a rotation-inhibiting structure; (c) a club head engaging member releasably engaged with the shaft engaging member, wherein the club head engaging member includes a retaining structure engaged with the rotation-inhibiting structure to prevent rotation of the club head engaging member with respect to the shaft engaging member; (d) a golf club head engaged with the club head engaging member; and (e) a securing system for releasably securing the club head engaging member with respect to the shaft engaging member. The club head/shaft connection assemblies may have any of the more detailed structures and/or features described above. Moreover, such assemblies may be included as part of golf club structures, e.g., in the same manners described above.

FIG. 1 generally illustrates an example golf club 100. This club 100 includes a club head 102, a releasable club head/shaft connection region 104 that connects the club head to a shaft 106 (which will be described in more detail below), and a grip member 108 engaged with the shaft 106. While a driver/wood-type golf club head 102 is illustrated in FIG. 1, aspects of this invention may be applied to any type of club head, including, for example: fairway wood club heads; iron type golf club heads (of any desired loft, e.g., from a 0-iron or 1-iron to a wedge); wood or iron type hybrid golf club heads; putter heads; and the like. The club heads may be made from conventional materials, in conventional constructions, in conventional manners, as are known and used in the art, optionally modified (if necessary, e.g., in size, shape, etc.) to accommodate the releasable club head/shaft connection parts.

Any desired materials also may be used for the shaft member 106, including conventional materials that are known and used in the art, such as steel, graphite, polymers, composite materials, combinations of these materials, etc. Optionally, if necessary or desired, the shaft may be modified (e.g., in size, shape, etc.) to accommodate the releasable club head/shaft connection parts. The grip member 108 may be engaged with the shaft 106 in any desired manner, including in conventional manners that are known and used in the art (e.g., via cements or adhesives, via mechanical connections, etc.). Any desired materials may be used for the grip member 108, including conventional materials that are known and used in the art, such as rubber, polymeric materials, cork, rubber or polymeric materials with cord or other fabric elements embedded therein, cloth or fabric, tape, etc. Optionally, if desired, the grip member 108 may be releasably connected to the shaft 106 using a releasable connection like releasable connection 104 (examples of which will be described in more detail below).

Figure 2A:
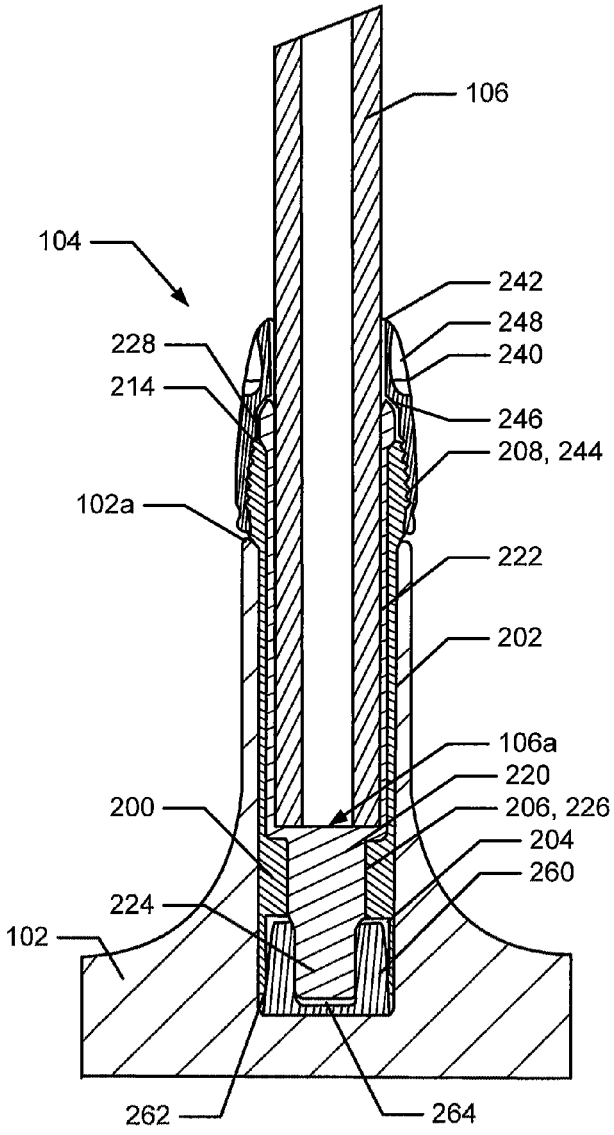
FIGS. 2A and 2B illustrate sectional views of an example golf club head/shaft connection assembly in both assembled (FIG. 2A) and exploded (FIG. 2B) conditions.
Figure 2B:
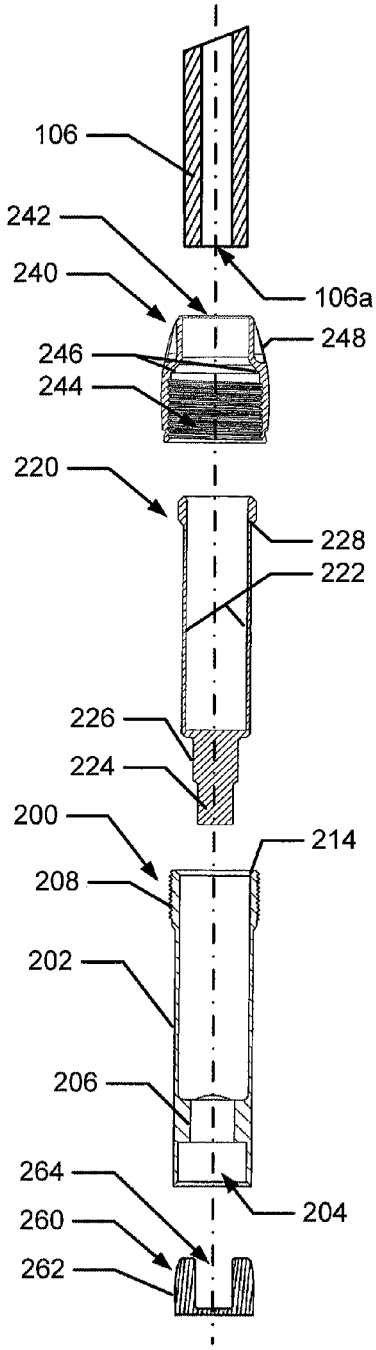

The releasable connection 104 between golf club heads and shafts now will be described in more detail in conjunction with FIGS. 2A through 6. FIG. 2A provides a detailed sectional view of one example releasable connection 104 between a golf club head 102 and a shaft 106, and FIG. 2B illustrates an exploded view of the parts involved in this example connection 104. As shown in these figures, this example connection 104 includes four main parts, namely: a club head engaging member 200, a shaft engaging member 220, a securing member 240, and a retaining member 260. The club head engaging member 200 includes a cylindrical outer surface 202 that fits into the opening 102*a* of the club head 102, e.g., at the hosel area of the club head 102, and the club head engaging member 200 may be permanently or releasably secured to the club head 102 in any desired manner, e.g., via cements or adhesives; via welding, brazing, soldering, or other fusing techniques; via mechanical connectors; via a friction fit; etc. Prior to engaging the club head engaging member 200 with the club head 102, if desired, the retaining member 260 may be secured within a lower interior chamber portion 204 of the club head engaging member 200. The retaining member 260 of this example structure 104 includes an outer surface 262 that fits into the lower interior chamber portion 204 of the club head engaging member 200 and may be secured thereto in any desired manner, e.g., via cements or adhesives; via welding, brazing, soldering, or other fusing techniques; via mechanical connectors; via a friction fit; etc.

The shaft engaging member 220 of this example structure 104 includes a cylindrical interior chamber 222 that may be fit over the free end 106*a* of the shaft 106 and may be secured thereto in any desired manner, e.g., via cements or adhesives; via welding, brazing, soldering, or other fusing techniques; via mechanical connectors; via a friction fit; etc. The securing member 240 fits over the free end 106*a* of the shaft 106 and is located along the shaft 106 above the shaft engaging member 220. The securing member 240 opening 242 is sized so as to be rotatable around the exterior of the shaft 106 for reasons to be described in more detail below.

Once the securing member 240 and the shaft engaging member 220 are engaged with the shaft 106 and the club head engaging member 200 (optionally including the retaining element 260) is engaged with the club head 102, the overall connection 104 then may be assembled. This is accomplished in this example connection structure 104 by sliding the shaft engaging member 220 into the interior chamber of the club head engaging member 200. As the shaft engaging member 220 slides through the club head engaging member 200, the projection portion 224 of the shaft engaging member 220 will extend into the bottom interior chamber portion 204 of the club head engaging member 200 and engage the interior chamber 264 of the retaining member 260. At this configuration, the rotation-inhibiting structures 226 of the shaft engaging member 220 will engage corresponding rotation-inhibiting structure 206 of the club head engaging member 200 to thereby prevent the shaft 106 from rotating with respect to the club head 102 (the retaining member 260 in this example structure 104 helps prevent any substantial "play" or movement of the shaft 106 with respect to the club head 102, e.g., due to tolerances in the rotation-inhibiting structures 206 and 226). The securing member 240 then slides down the shaft 106, over the upper end of the shaft engaging member 220, and threadingly engages threaded securing structures 208 provided on the club head engaging member 200. Other releasable mechanical connection systems are possible without departing from this invention. Also, the various steps in this example assembly procedure may be changed, combined, changed in order, etc., without departing from this invention.

To release the connection 104, the threaded (or other) securing member 240 is released from the club head engaging member 200, which allows the shaft engaging member 220 to be slid out of the club head engaging member 200 (the shaft engaging member 220 and the securing member 240 remain on the shaft 106 and the club head engaging member 200 and the retaining member 260 remain in the club head 102). In this manner, a different shaft can be quickly and easily engaged with the same club head 102 and/or a different club head can be quickly and easily engaged with the same shaft 106.

Figure 3A:
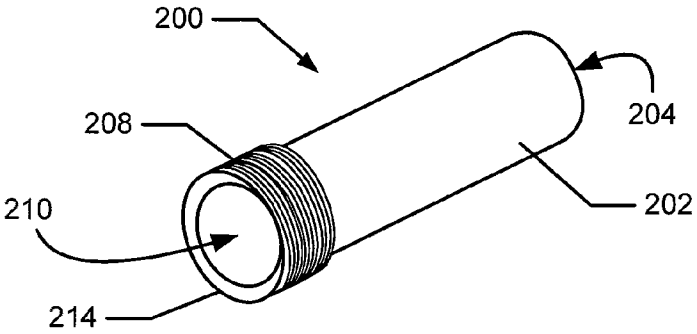
FIGS. 3A through 3C illustrate an example golf club head engaging member that may be used in golf club head/shaft connection assemblies.
Figure 3B:
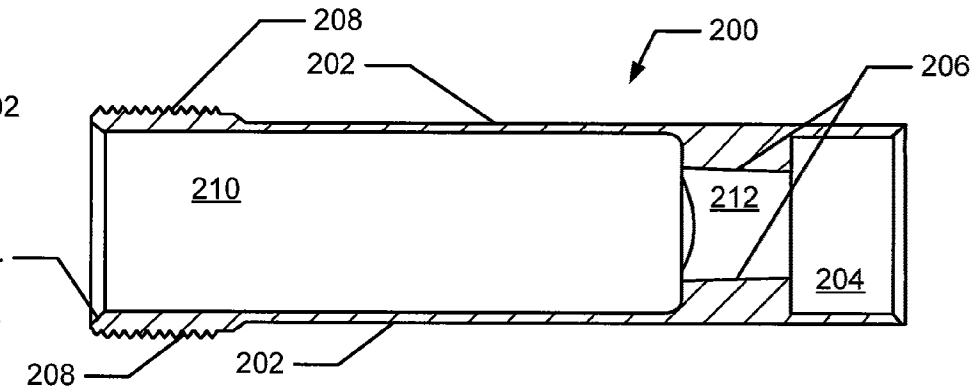
Figure 3C:
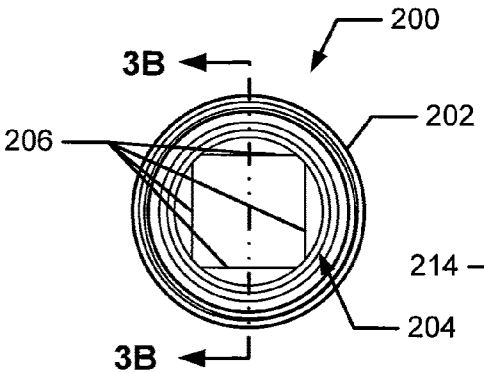

The various individual parts of this example connection structure 104 now will be described in more detail in conjunction with FIGS. 3A through 6. FIGS. 3A through 3C illustrate the club head engaging member 200 in a perspective view (FIG. 3A), a top view (FIG. 3C), and a cross sectional view (FIG. 3B, taken along lines 3B-3B in FIG. 3C). As illustrated, in this example connection structure 104, the club head engaging member 200 is a cylindrical tube (round) structure with an open threaded end 208 and an opposite open end (adjacent interior chamber 204). The interior of the club head engaging member 200 includes a first tubular section 210 for receiving a portion of the shaft engaging member 220, a polygon shaped opening 212 providing rotation-inhibiting structures 206 (or side walls) that engage the rotation-inhibiting structures 226 of the shaft engaging member 220, and the bottom interior chamber 204 for receiving the projection 224 and the retaining member 260. If desired, the rotation-inhibiting structures or side walls 206 may be somewhat sloped (larger or wider toward tubular section 210 as compared to bottom interior chamber 204) to enable easier engagement/disengagement with the rotation-inhibiting structures 226 of the shaft engaging member 220. The outer surface 202 of the club head engaging member 200 may be sized and shaped to fit within and closely engage an opening and/or hosel side walls provided in a golf club head for receiving a shaft (e.g., a hosel opening or other shaft receiving opening provided in a golf club head). The upper free end 214 of the club head engaging member 200 (adjacent the threads 208) is sized and shaped so as to engage shoulder structure 228 on the shaft engaging member 220 and to help stably position the various parts of the connection structure 104 with respect to one another.

Figure 4A:
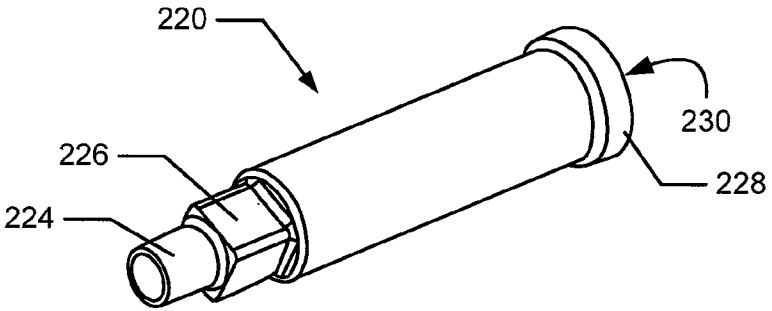
FIGS. 4A through 4D illustrate an example shaft engaging member that may be used in golf club head/shaft connection assemblies.
Figure 4B:
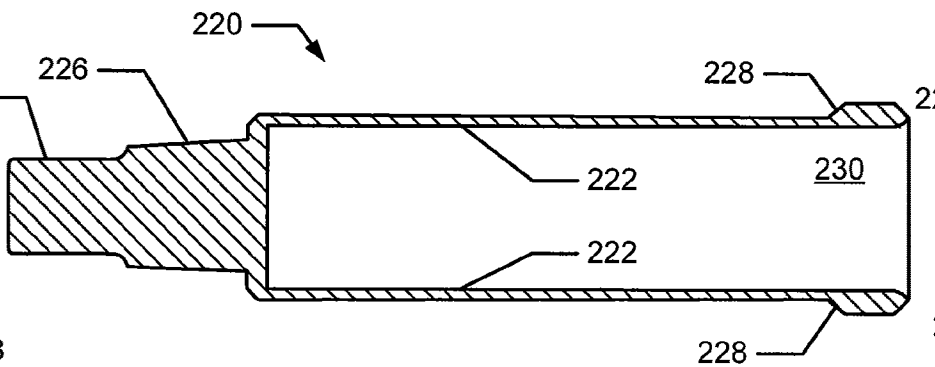
Figure 4C:
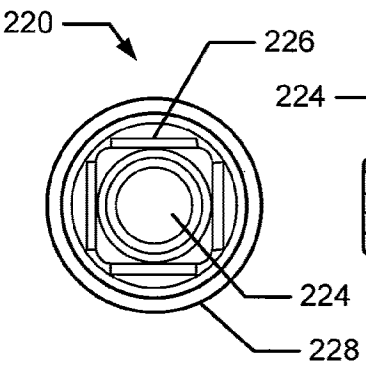
Figure 4D:
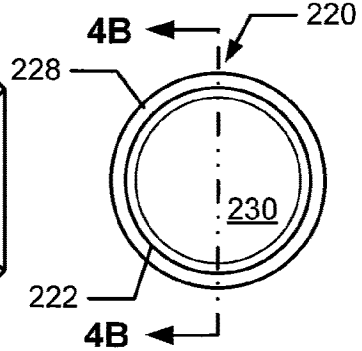

FIGS. 4A through 4D provide a more detailed view of the shaft engaging member 220 of this example connection structure 104. FIG. 4A is a perspective view of this example shaft engaging member 220, FIG. 4D is a top view, FIG. 4C is a bottom view, and FIG. 4B is a cross sectional view taken along line 4B-4B in FIG. 4D. As shown, the shaft engaging member 220 includes an interior chamber 230 for receiving the golf club shaft 106. The rotation-inhibiting member 226 extends away from the chamber 230 in the longitudinal or axial direction of the shaft engaging member 220, and the retaining projection 224 extends in the axial direction beyond the rotation-inhibiting member 226. As described above, the rotation-inhibiting member 226 extends into the correspondingly shaped opening 212 provided in the club head engaging member 200 to thereby help prevent rotation of the shaft engaging member 220 with respect to the club head engaging member 200. Like the side walls 206 of the opening 212, if desired, the rotation-inhibiting member 226 may have somewhat sloped side walls (larger or wider toward chamber 230 as compared to retaining projection 224) to enable easier engagement/disengagement with the rotation-inhibiting structures 206 of the club head engaging member 200.

Figure 5C:
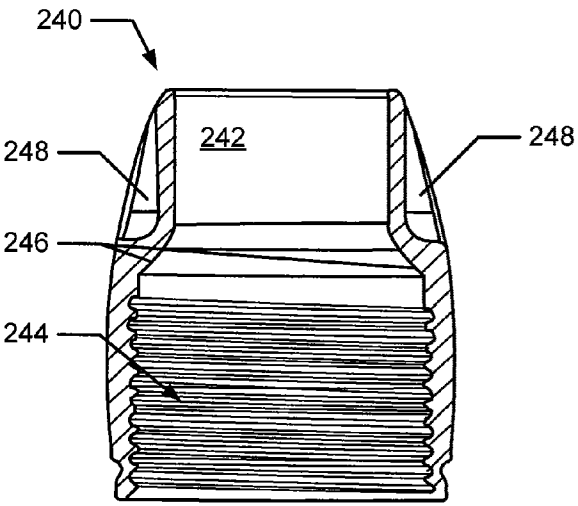
FIGS. 5A through 5C illustrate an example securing member that may be used in golf club head/shaft connection assemblies.
Figure 5A:
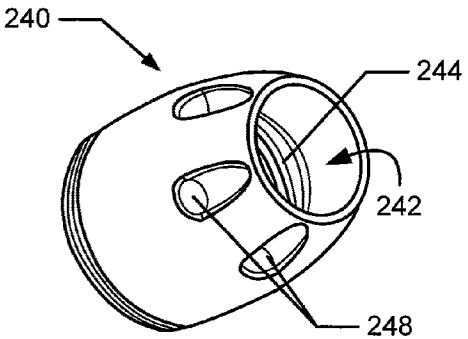
Figure 5B:
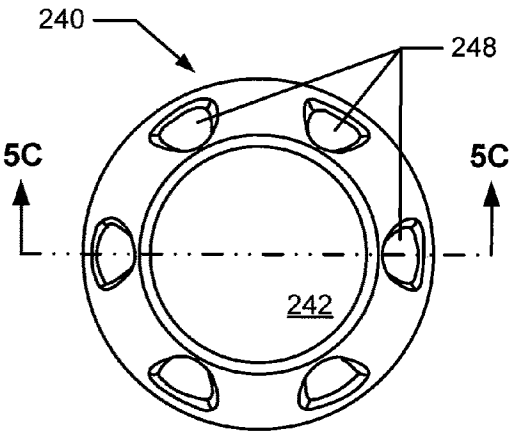

The club head/shaft securing member 240 is illustrated in more detail in FIGS. 5A through 5C (FIG. 5A is a perspective view, FIG. 5B is a top view, and FIG. 5C is a cross sectional view taken along lines 5C-5C in FIG. 5B). The securing member 240 includes an axial opening 242 sized and shaped so as to enable the securing member 240 to freely slide along the free end of the shaft 106. The interior of the securing member 240 includes threads 244 (or other securing structures) for engaging the securing structures 208 provided on the club head engaging member 200. Interior shoulder regions 246 (in this example structure 240 defined by indentations 248) provide structure to engage and hold down the top portion 228 of the shaft engaging member 220 when the securing member 240 engages the club head engaging member 200.

The various parts of the club head/shaft connection system 104 may be made from any desired or suitable materials without departing from this invention. For example, one or more of the various parts 200, 220, and/or 240 may be made from a metal material, including lightweight metals conventionally used in golf club head constructions, such as aluminum, titanium, magnesium, nickel, alloys of these materials, steel, stainless steel, and the like, optionally anodized finished materials. Alternatively, if desired, one or more of the various parts 200, 220, and/or 240 may be made from rigid polymeric materials, such as polymeric materials conventionally known and used in the golf club industry. The various parts 200, 220, and 240 may be made from the same or different materials without departing from this invention. In one specific example, each of the various parts 200, 220, and 240 will be made from a 7075 aluminum alloy material having a hard anodized finish. The parts may be made in conventional manners as are known and used in the metal working and/or polymer production arts.

Figure 6:
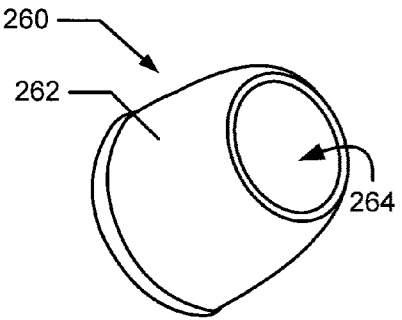
FIG. 6 illustrates an example retaining member that may be used in golf club head/shaft connection assemblies.

FIG. 6 illustrates the last part of this example club head/shaft connection structure 104, namely, the retaining member 260. The retaining member 260 in this example structure 104 includes an exterior wall 262 sized to fit into (and frictionally engage) the interior chamber 204 of the club head engaging member 200. The retaining member 260 may be engaged with the club head engaging member 200 in other ways, such as via adhesives or cements, fusing techniques, mechanical connectors, etc. Additionally, the retaining member 260 of this example structure includes an interior chamber 264 that engages the free end of the projection 224 of the shaft engaging member 220. The retaining member 260 further helps hold the shaft engaging member 220 in place with respect to the club head engaging member 200. While it may be made from a wide variety of materials, such as cloth, fabric, rubber, and the like, in this illustrated example structure 104, the retaining member 260 is made from a somewhat flexible polymeric material, e.g., by a molding technique, such as injection molding. In addition to helping hold the shaft engaging member 220 in place with respect to the club head engaging member 200, the material of the retaining member 260 can help attenuate or eliminate noises, e.g., by preventing the metallic parts of the connection 104 from slightly moving with respect to one another or rattling when the club head 102 is moved. If desired, the retaining member 260 may be omitted, relocated, and/or integrally formed as part of the shaft, the club head engaging member, etc.

Many variations in the connection system may be made from the specific structures described above without departing from this invention. For example, if desired, the securing member (e.g., like member 240) may be fit onto the club head structure 102 (e.g., around the hosel), and it may engage external threads (or other securing structures) provided on the shaft engaging member 220. Releasable securing systems other than threaded engagements of a securing member 240 with the club head engaging member 200 and/or the shaft engaging member 220 are possible without departing from this invention. For example, the securing member 240 may include structures that extend into or otherwise engage the club head engaging member 200 and/or the shaft engaging member 220 to thereby hold these members in place with respect to one another. As another example, if desired, the securing member 240 may include slots, openings, or grooves that provide access to structures extending from the club head engaging member 200 and/or the shaft engaging member 220 to thereby hold these members in place with respect to one another. As yet another example, if desired, the separate securing member 240 may be omitted, e.g., if the club head engaging member 200 and/or the shaft engaging member 220 directly include adequate structures to hold themselves in place with respect to one another. The securing member 240 also may be integrally formed or connected with another part of the connection structure 104, the club head 102, and/or the shaft 106.

As another example, the rotation-inhibiting portions 206 and 226 may take on a variety of different structures, such as polygon structures having 20 sides or less, 16 sides or less, 12 sides or less, 10 sides or less, 8 sides or less, or even 6 sides or less. The rotation-inhibiting opening 206 need not exactly match the shape of the rotation-inhibiting structure 226, provided the rotation-inhibiting structure 226 engages some portion of the rotation-inhibiting opening 206 so as to prevent undesired rotation of the shaft engaging member 220 with respect to the club head engaging member 200. Other rotation-inhibiting structures and arrangements also are possible without departing from this invention. For example, either or both of the shaft engaging member 220 and the club head engaging member 200 may include mechanical structures that engage the other part or other parts of the overall golf club so as to prevent rotation. As some more specific examples, the shaft engaging member may include spring loaded pins or other extending structures that extend into openings, slots, or ridges provided in the club head engaging member (and/or vice versa) (e.g., akin to attachment of hydraulic hoses to their hydraulic oil supply connection elements). Detent mechanisms and other physical (and optionally static) securing structures that fit into openings, slots, or ridges also may be used as a releasable rotation-inhibiting connection without departing from this invention.

Figure 7A:
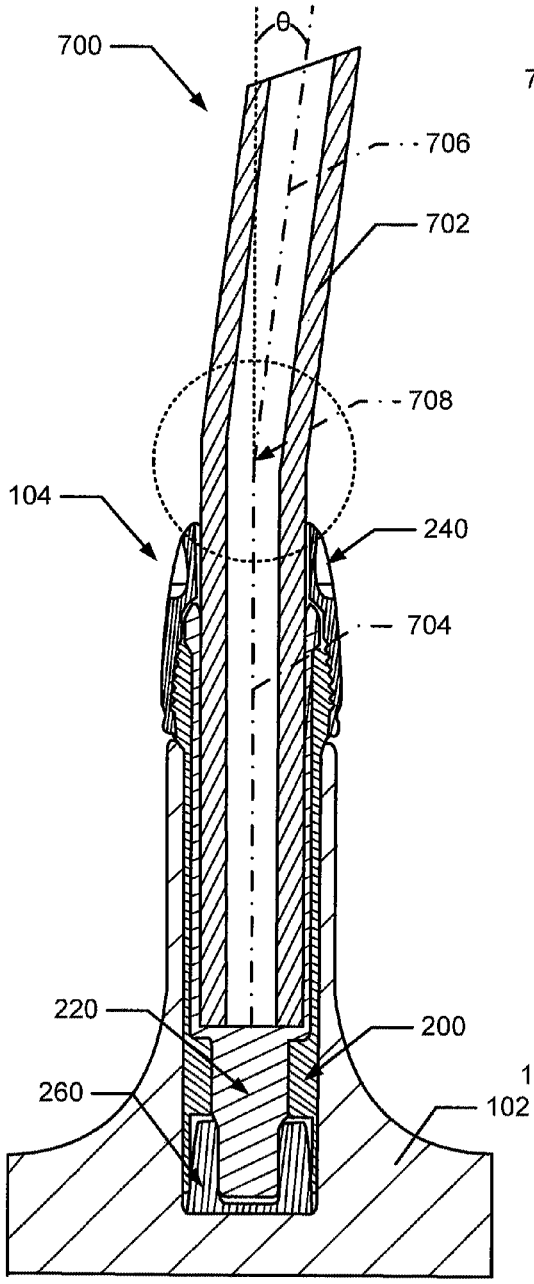
FIGS. 7A and 7B illustrate example aspects relating to use of an angled shaft member in releasable golf club head/shaft connection assemblies.
Figure 7B:
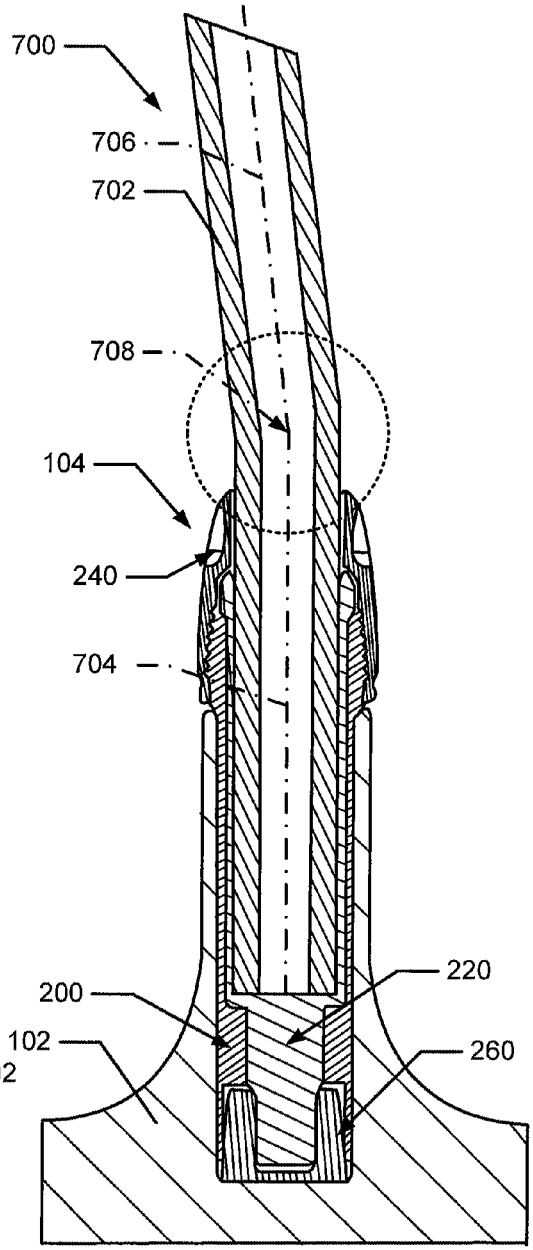

Additional aspects relate to utilizing releasable golf club head/shaft connection assemblies to enable club fitters (or others) to adjust various positions and/or angles of the club head (and its ball striking face) with respect to the free (grip) end of the shaft (e.g., lie angle, loft angle, etc.). FIGS. 7A and 7B illustrate one example golf club head/shaft connection system 700 in which these angles can be controlled and adjusted. More specifically, FIGS. 7A and 7B illustrate a releasable golf club head/shaft connection assembly 104 similar to that described above in conjunction with FIGS. 2A through 6 (the same or similar reference numbers are used in FIGS. 7A and 7B as those used in FIGS. 1 through 6 to denote the same or similar parts). The shaft 702, however, in this example structure 700, is bent so as to include a first axial direction 704 extending coaxial with the hosel element extending from the golf club head 102 and a second axial direction 706 extending along a major portion of the shaft 702. The axial direction change region 708 (optionally an abrupt bend or a continuous and/or smooth change) transitions the shaft axial direction from the first direction 704 to the second direction 706.

As evident from a comparison of FIGS. 7A and 7B, the angle and/or position of the free end of the shaft 702 (at the location of the grip, remote from the connection assembly 104) may be altered with respect to the club head 102 (and with respect to the ball striking face) by rotating the shaft engaging member 220 with respect to the club head engaging member 200. This feature, along with the releasable connection system 104, allows club fitters (or others) to freely and easily adjust various angles and/or positions of the shaft 702 with respect to the club head 102 (e.g., variable lie, loft, and face angle combinations) while still using the same shaft 702 and head 102, which can help users more easily determine the optimum club head/shaft combination and arrangement to suit their needs.

The axial direction change region 708 may be located at any desired position along the shaft 702 without departing from this invention. In at least some example structures 700 according to this invention, the axial direction change region 708 will be located in the lower half of the shaft 702 nearer to the club head 102 than to the grip end. In some more specific examples, the axial direction change region 708 will be located in the lower quarter of the shaft 702 nearest to the club head 102, and even in the lower 10% or 5% of the shaft 702 nearest to the club head 102. In some example structures 700 according to the invention, the bend or other axial direction change region 708 may be located as close to the securing member 240 or other portion of the connection assembly as possible while still leaving a sufficient distance from the end of the shaft 702 so as to allow free movement of the securing member 240 or other securing mechanism. Alternatively, if desired, the securing member 240 or other securing mechanism may be sized and arranged so as to slip over the axial direction change region 708, and/or it may be releasable from, removable from, and/or attachable to the shaft 702 or other portion of the assembly 104 in another manner.

Also, any desired axial direction change θ (or bend) angle may be used without departing from this invention, e.g., at least 0.25 degrees, at least 0.5 degrees, at least 1 degree, at least 2 degrees, at least 4 degrees, or even at least 8 degrees. In some example structures, this bend or other axial direction change will be between 0.25 and 25 degrees, between 0.5 and 15 degrees, between 1 and 10 degrees, or even between 1 and 5 degrees.

As noted above, FIGS. 7A and 7B illustrate the bent or angled shaft 702 used in conjunction with the connection system 104 described above in connection with FIGS. 2A through 6. This is not a requirement. The various aspects of the invention described above in conjunction with FIGS. 7A and 7B may be used with other releasable golf club head/shaft connection arrangements, such as those described in U.S. Pat. No. 6,890,269 (Bruce D. Burrows) and U.S. Published patent appln. No. 2004/0018886 (Bruce D. Burrows), each of which is entirely incorporated herein by reference. Moreover, various aspects of the invention described above in conjunction with FIGS. 7A and 7B may be used in connection with other patented, pending, and/or commercially available releasable golf club shaft assemblies.

The golf club shafts are not limited to having a single axial direction change region. Rather, as illustrated by the structure 800 shown in FIG. 8A, the shaft 802 may have multiple axial direction change regions (e.g., regions 804 and 806 in FIG. 8A (in FIG. 8A, the same or similar reference numbers are used as those used in FIGS. 1 through 7B to denote the same or similar parts)). This feature allows further fine tuning or control of the position and/or angle of the free end of the shaft 802 (at the grip) with respect to the club head 102 and its ball striking face (e.g., to adjust positions to provide a range of inset, outset, onset, and offset positions and/or optionally to adjust lie, loft, and/or face angle features).

Figure 8A:
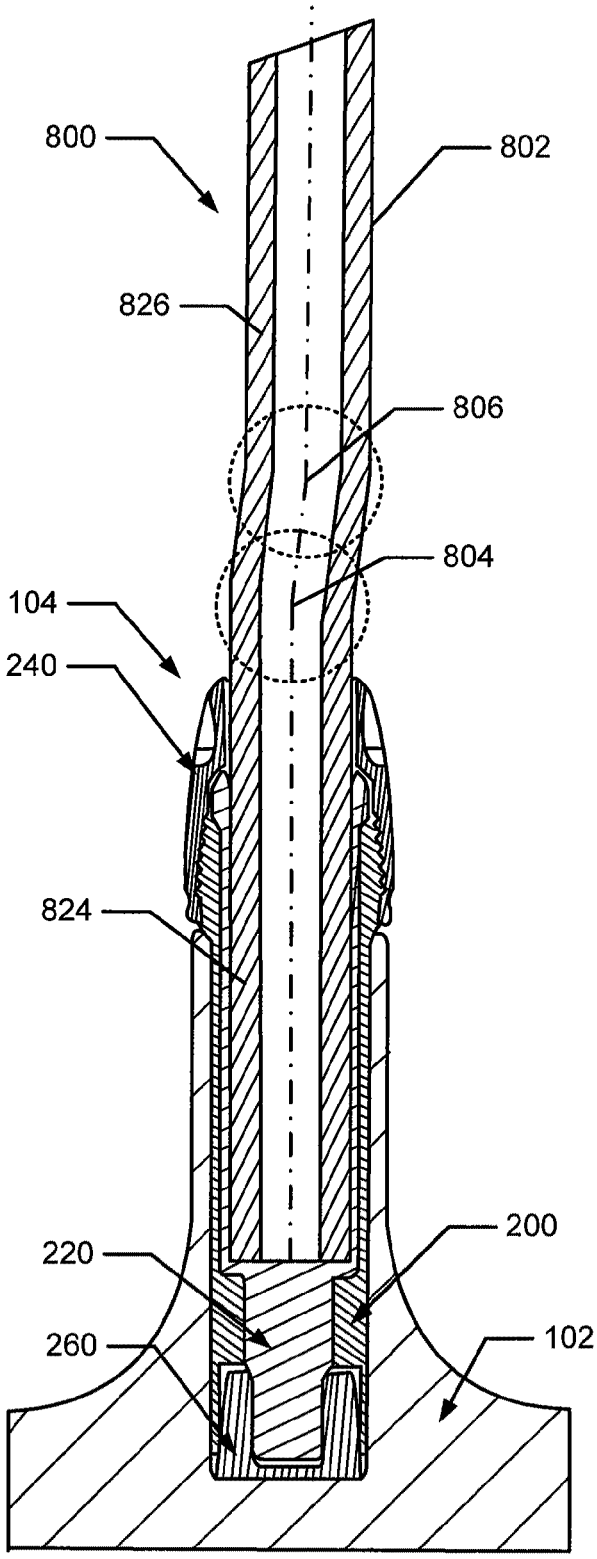
FIGS. 8A and 8B illustrate additional example aspects relating to use of an angled shaft member in releasable golf club head/shaft connection assemblies.
Figure 8B:
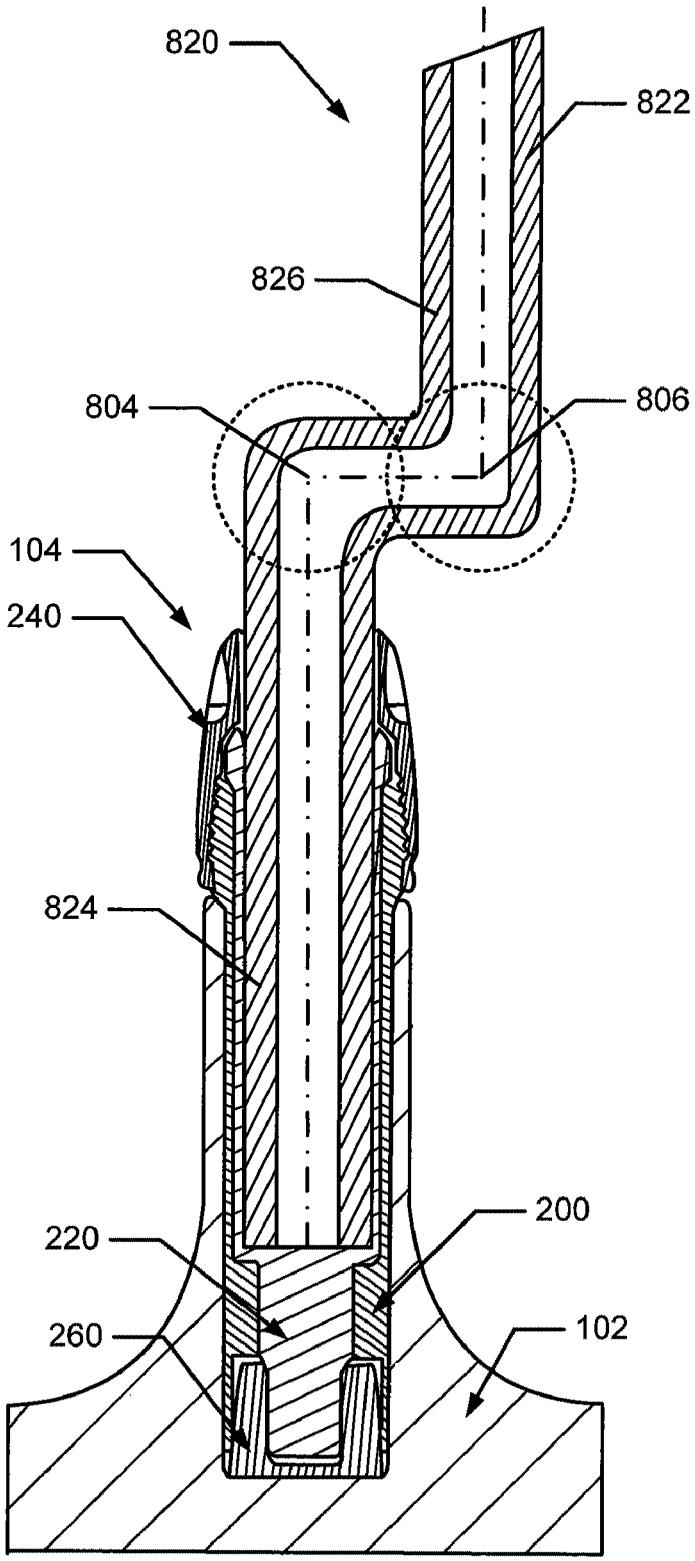

FIG. 8B illustrates another example structure 820 including a releasable golf club head/shaft connection assembly (e.g., like assembly 104) and a shaft 822 having two (or more) axial direction change regions 804 and 806 like those illustrated in FIG. 8A. In this example structure 820, however, the shaft 822 has more abrupt direction change as compared to the structure 800 and shaft 802 of FIG. 8A. This shaft structure 822 also allows control of the position and/or angle of the free end of the shaft 822 (at the grip) with respect to the club head 102 and its ball striking face (e.g., to adjust positions to provide a range of inset, outset, onset, and offset positions and/or optionally to adjust lie, loft, and/or face angle features).

The axial direction change regions 804 and 806 in the various structures (e.g., structures 800 and 820) may be located at any desired positions along the shafts 802 and/or 822 and/or at any desired relative spacing with respect to one another without departing from this invention. In at least some example structures 800 and/or 820 according to this invention, at least one of the axial direction change regions 804 and 806 (and optionally both) will be located in the lower half of the shaft 802 and/or 822 nearer to the club head 102 than to the grip end. In some more specific examples, one or both of the axial direction change regions 804 and 806 will be located in the lower quarter of the shaft 802 and/or 822 nearest to the club head 102, and even in the lower 10% or 5% of the shaft 802 and/or 822 nearest to the club head 102. The axial direction change regions 804 and 806 may be separated from one another by at least ½ inch, at least 1 inch, at least 2 inches, or even at least 4 inches or more without departing from this invention. The bends or other axial direction change regions 804 and 806 may be located a sufficient distance from the end of the shaft 802 and/or 822 and/or from one another so as to allow free movement of the securing member 240 or other securing mechanism, if necessary. Alternatively, if desired, the securing member 240 or other securing mechanism may be sized and arranged so as to slip over one or both of the axial direction change regions 804 and/or 806, and/or it may be releasable from, removable from, and/or attachable to the shaft 802 and/or 822 or other portion of the assembly 104 in another manner.

Also, any desired axial direction change (or bend) angles may be used for each of the two (or more) direction changes without departing from this invention, e.g., at least 0.25 degrees, at least 0.5 degrees, at least 1 degree, at least 2 degrees, at least 4 degrees, or even at least 8 degrees. In some example structures, like those shown in FIG. 8A, these bends or other axial direction changes will be between 0.25 and 25 degrees, between 0.5 and 15 degrees, between 1 and 10 degrees, or even between 1 and 5 degrees. In other example structures, like those shown in FIG. 8B, these bends or other axial direction changes will be between 25 and 145 degrees, between 30 and 120 degrees, between 45 and 100 degrees, or even between 60 and 90 degrees. If desired, one bend may be relatively slight (e.g., as shown in FIG. 8A) while another is more abrupt (e.g., as shown in FIG. 8B). The bends or axial direction changes 802 and 804 may be arranged so that the free ends of the shaft (and the shaft sections 824 and 826 including the free ends) lie on the same plane or on different planes. Also, if desired, more than two bends or axial direction change regions may be provided in a club head shaft structure without departing from this invention.

Like the structure 700 described above in conjunction with FIGS. 7A and 7B, the bent or angled shaft 802 and/or 822 may be used in conjunction with the connection system 104 described above in connection with FIGS. 2A through 6. This is not a requirement. The aspects of the invention described above in conjunction with FIGS. 8A and 8B may be used with other releasable golf club head/shaft connection arrangements, such as those described in U.S. Pat. No. 6,890,269 (Bruce D. Burrows) and U.S. Published patent appln. No. 2004/0018886 (Bruce D. Burrows), and those described in other patents, pending patent applications, publications, and/or commercially available releasable golf club shaft assemblies.

Figure 9A:
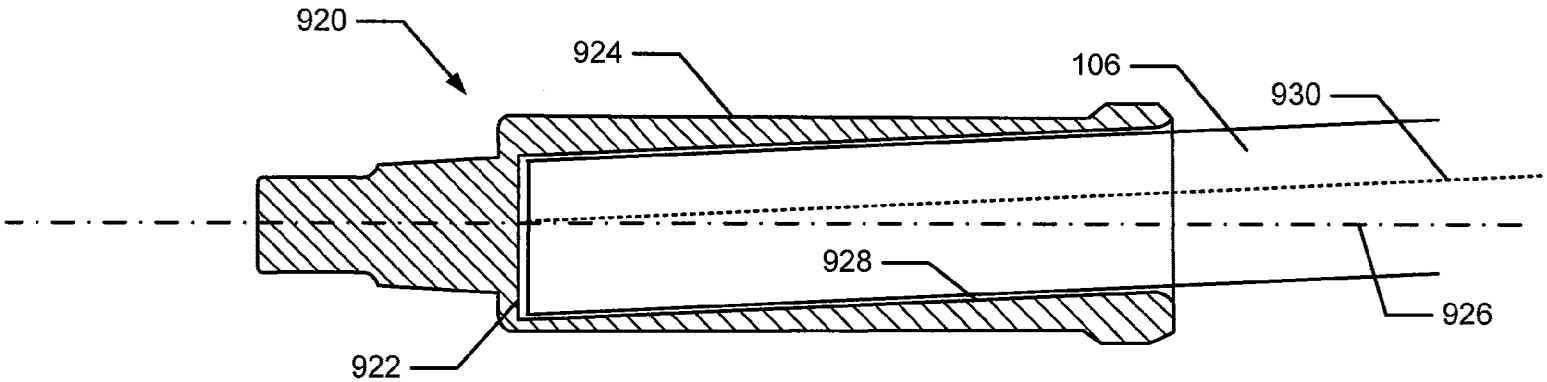
FIGS. 9A and 9B illustrate example aspects relating to use of an off-axis or angled member for selectively positioning a free end of a shaft with respect to a golf club head face in releasable golf club head/shaft connection assemblies.
Figure 9B:
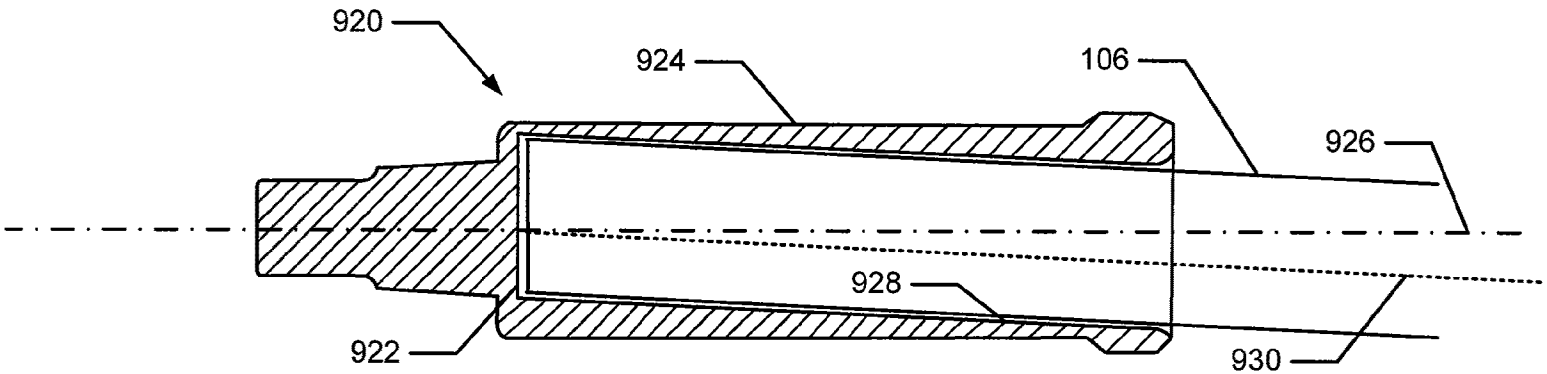

Utilizing a shaft including one or more axial direction change regions is not the only manner in which the position and/or angle of the free (grip) end of a shaft may be altered with respect to a golf club head and/or its ball striking face. FIGS. 9A and 9B illustrate another example arrangement. In this example arrangement, the shaft engaging member 920 includes an "off-axis" or angled bore hole 922 in which the shaft 106 is received. More specifically, in this illustrated example, the outer cylindrical surface 924 of the shaft engaging member 920 (which matches the direction of an interior chamber of a club head engaging member) extends in a first axial direction 926, and the interior cylindrical surface 928 of the bore hole 922 extends in a second axial direction 930 that differs from the first axial direction 926. In this manner, while the shaft engaging member 920 exterior maintains a constant axial direction corresponding to that of the interior of the club head engaging member (e.g., member 200), the shaft 106 extends away from the club head 102 at a different and adjustable angle with respect to the club head 102 and its ball striking face (the shaft position and/or angle may be adjusted, for example, by rotating the shaft engaging member 920 with respect to the club head engaging member 200). This may be seen, for example, by a comparison of the angles of FIGS. 9A and 9B.

While any desired angle may be maintained between the first axial direction 926 and the second axial direction 930, in accordance with some examples of this invention, this angle will be between 0.25 degrees and 10 degrees, and in some examples between 0.5 degrees and 8 degrees, between 0.75 degrees and 6 degrees, or even between 1 degree and 4 degrees.

If desired, the shaft engaging member 920 described above may be used in connection with a shaft connection assembly similar to those described above in conjunction with FIGS. 1-8B. The securing member 240 may have sufficient space or play (and/or the angle of the angled bore 922 may be sufficiently small) so as to enable the securing member 240 to slide over the angle between the shaft 106 and the shaft engaging member 920 exterior surface 924. Alternatively, different securing arrangements may be used to engage the shaft engaging member 920 with the club head and/or the club head engaging member without departing from this invention, including, for example, any of the various securing arrangements and variations thereon described above.

Also, while this specific structure has been described in conjunction with the figures, golf club head/shaft connection structure, and terminology used above in FIGS. 1 through 9B, these aspects (the angled bore hole) may be extended to other releasable golf club head/shaft connection assemblies that include a member in which the shaft is mounted, such as the assemblies described in U.S. Pat. No. 6,890,269 (Bruce D. Burrows) and U.S. Published Patent Appln. No. 2004/0018886 (Bruce D. Burrows) and/or those used in conjunction with other patented, pending, published, and/or commercially available releasable shaft assemblies. These aspects also may be used with shafts having one or more axial direction change regions, if desired (such as shafts 802 and/or 822 as illustrated in FIGS. 8A and 8B).

Moreover, the use of an off-axis or angled bore member to alter the club head/shaft angle and/or position characteristics is not limited to use of an off-axis or angled bore in a shaft engaging member. Rather, if desired, the club head engaging member and/or the club head hosel may have an angled bore for receiving the shaft assembly, and the club head/shaft angle and/or position characteristics may be selectively altered by changing the orientation of the club head engaging member and/or the club head hosel with respect to other portions of the overall structure.

Many variations in the overall structure of the shaft, club head, and club head/shaft connection assembly are possible without departing from this invention. For example, if desired, the structure 104 may be somewhat "inverted" such that the securing member 240 is located on the club head (e.g., around the hosel) and it engages the shaft, the shaft engaging member, and/or the club head engaging member to hold the various parts together. Moreover, if desired, the connection system 104 may be used to connect shafts to other elements of a golf club (or other) structure, such as connecting a golf club shaft to a grip element.

Figure 10B:
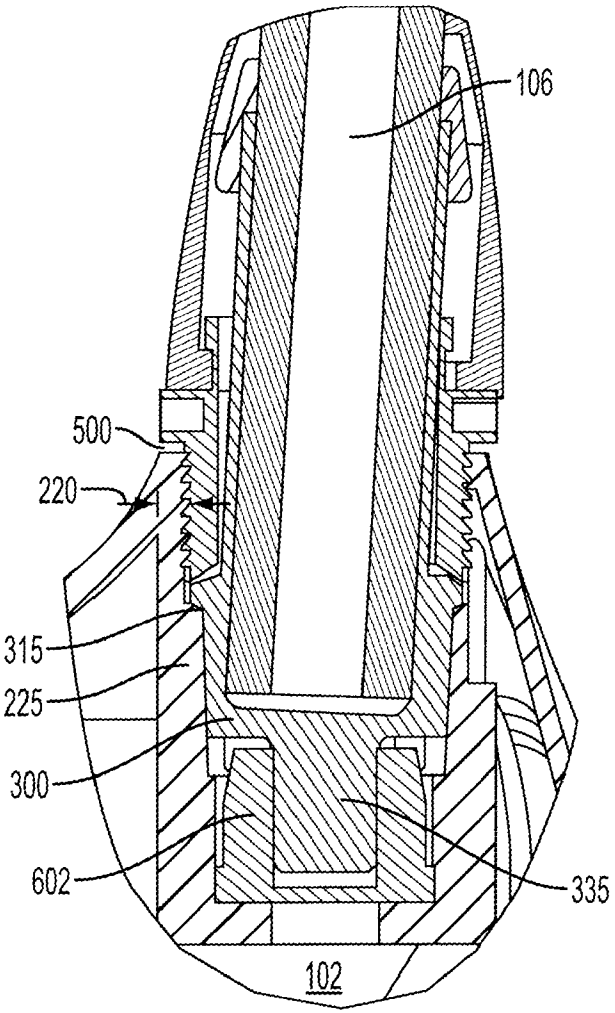
FIGS. 10A and 10B illustrative an alternative releasable golf club head/shaft connection assembly.
Figure 10A:
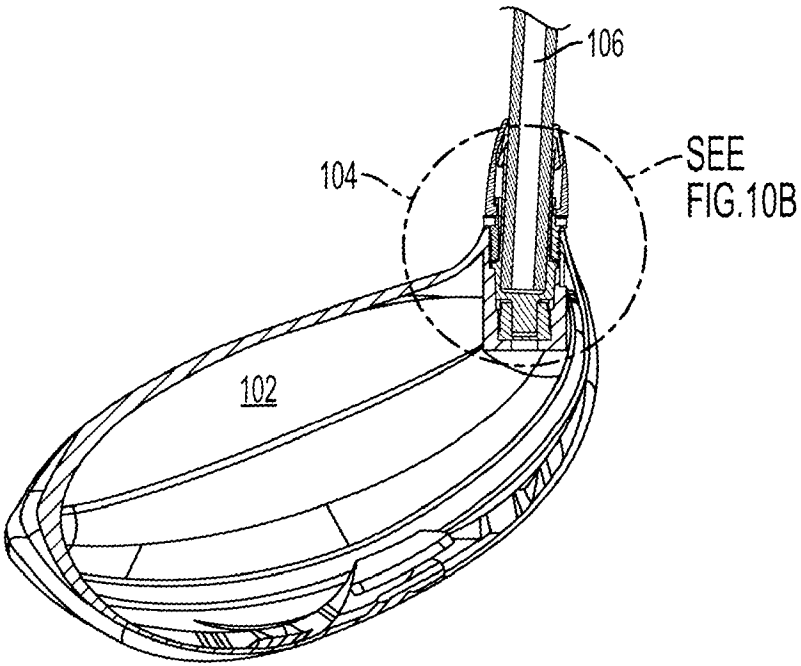

An example of an alternative club head/shaft connection assembly is shown in FIGS. 10A and 10B. The angle and/or position of the free end of the shaft 106 (at the location of the grip, remote from the connection assembly 104) may be altered with respect to the club head 102 (and with respect to the ball striking face) by differing the rotational placement of rotation inhibiting structure 315 of shaft adapter 300 within the club head 102.

Specifically, FIG. 10B shows an enlarged cross-section view of connection assembly 104 according to one embodiment. As shown, the rotation inhibiting structure 315 of the shaft adapter 300 is selectively received within the rotation inhibiting structure 225 of the interior chamber of the club head 102. Depending on how the shaft adapter 300 is oriented within the club head 102, and thus on how the direction change region is oriented in relation to the "face" of the club head 102, the playing characteristics of the club (e.g., its face angle, its loft angle, its lie angle, etc.) may be adjusted. This feature, along with the releasable connection system 104, allows club fitters (or others) to freely and easily adjust various angles and/or positions of the shaft 106 with respect to the club head 102 (e.g., variable lie, loft, and face angle combinations) while still using the same shaft 106 and head 102, which can help users more easily determine the optimum club head/shaft combination and arrangement to suit their needs.

Receiving mechanism 220 proximate to the exterior portion of the golf club head 200 may be configured to receive and secure a shaft retainer 500. As shown in FIG. 10B, the receiving mechanism 220 may comprise threaded securing structures that are configured to threadingly engage the threaded structures of a complementing shaft retainer 500. Once the shaft retainer 500 is axially and rotationally engaged with the shaft 106, the overall connection 104 then may be assembled. This is accomplished in this example connection assembly 104 by sliding the shaft 106 into the upper end 305 of the shaft adapter 300 with the shaft retainer 500 located on the shaft 106 above the adapter 300. If desired, the shaft 106 may be fixed to the shaft adapter 300, e.g., by cements or adhesives, by mechanical connectors, etc. The shaft adapter 300 is slid into the interior chamber of the club head 102.

As the shaft adapter 300 slides into the club head 102, the rotation-inhibiting structures 225 of the head 102 will engage corresponding rotation-inhibiting structures 315 of the shaft adapter 300 to thereby prevent the shaft 106 from rotating with respect to the club head 102. The retaining member 335 of the shaft adapter 300 in this example assembly 104, along with its covering retaining portion 602 (such as a plastic or rubber washer or grommet) helps prevent any substantial "play" or movement of the shaft 106 with respect to the club head 102, e.g., due to tolerances in the rotation-inhibiting structures 225 and 315. Specifically, the retaining member 335 and its previously attached retaining portion 602 (if any) slide into and fit within the retaining portion 230 of the interior chamber of the head 102. As shown in FIG. 10B, the retaining portion 602 is made from a more compressible material, such as rubber that increases the surface tension and between the shaft adapter 300 and the club head 102. Alternatively, rather than placing the retaining portion 602 on the shaft adapter 300, prior to engaging shaft retainer 500 with the club head 102, if desired, a grasping structure having a hollow body portion may be inserted into the interior chamber 215 to serve as the retaining portion 602. If desired, the grasping structure that serves as the retaining portion 602 may include an outer surface that fits into the lower interior chamber 230 of the club head 102 and may be secured thereto in any desired manner, e.g., via cements or adhesives; via welding, brazing, soldering, or other fusing techniques; via mechanical connectors; via a friction fit; etc. This retaining portion 602, if desired, may expand outward under compressive forces, e.g., such as the forces applied when the shaft retainer 500 is engaged with the receiving mechanism 220. Other details of the club head/shaft connection assembly shown in FIGS. 10A and 10B and methods for the assembly thereof are described in co-pending U.S. application Ser. No. 12/177,778.

Figure 11B:
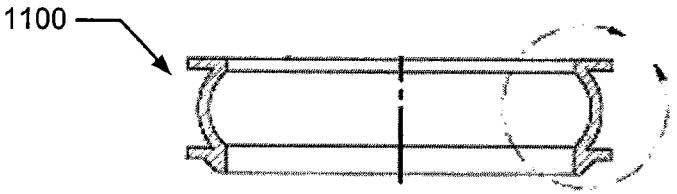
FIGS. 11A and 11B illustrate an intermediate ring that may be included with releasable club head/shaft connection assemblies.
Figure 12B:
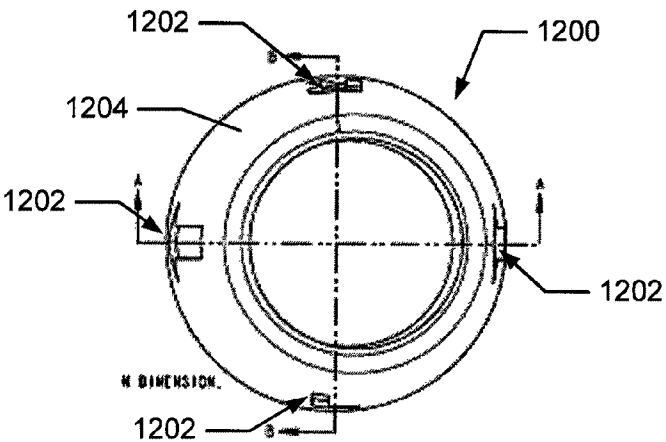
FIGS. 12A through 12E illustrate a cover member that may be included with releasable club head/shaft connection assemblies.
Figure 11A:
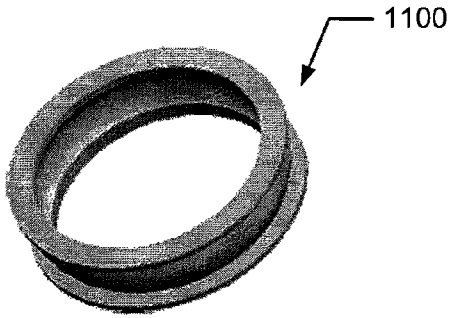
Figure 12A:
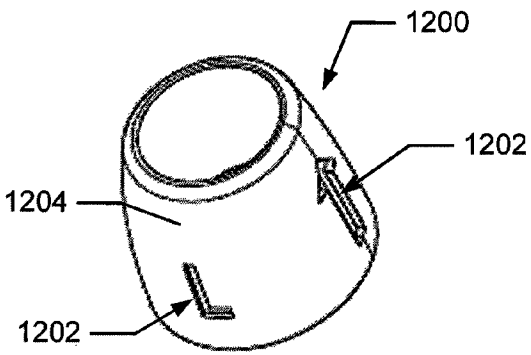
Figure 12D:
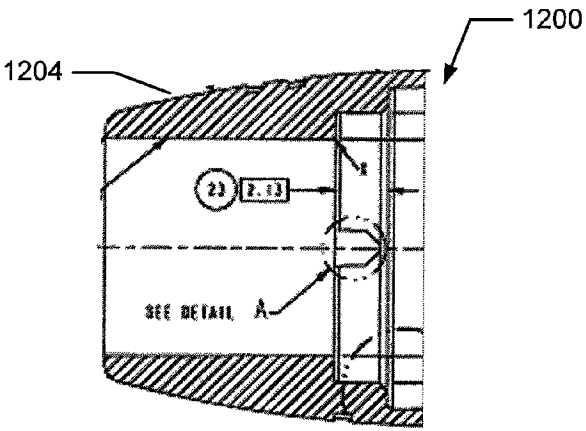
Figure 12C:
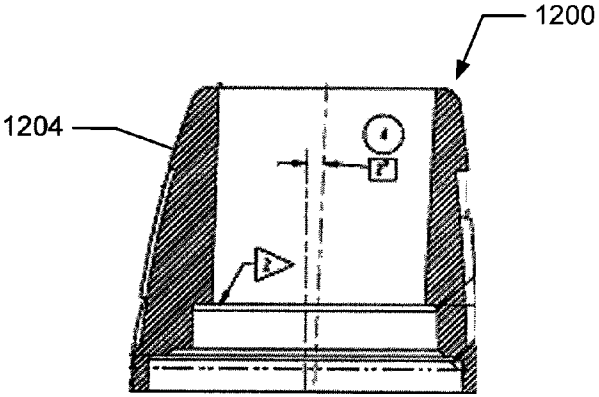
Figure 12E:
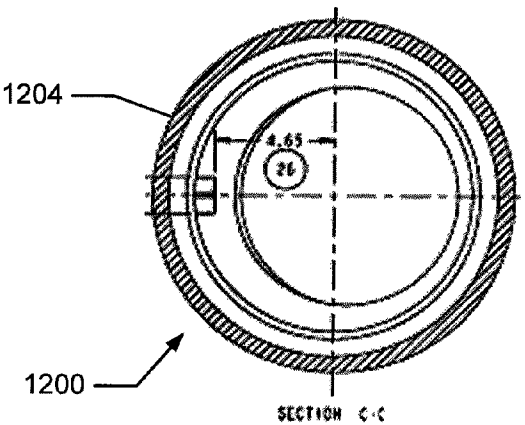

FIGS. 11A and 11B illustrate perspective and cross-section views, respectively, of a spacer element 1100 that optionally may be included in club head/shaft connection assemblies in accordance with at least some examples of this invention. This annular ring shaped spacer element 1100 may be provided to take up any space between the locking nut and the club head retaining portion once the club head and shaft are assembled together. The spacer element 1100 may be made from a compressible material, such as a thermoplastic polymer (e.g., Santoprene®, available from ExxonMobil Chemical, Inc.), rubber, soft metal, flexible metal structures, or the like, such that it may be compressed between the locking nut and the club head retaining portion once the club head and shaft are assembled together. The spacer element 1100 may improve the overall aesthetic appearance of the assembly, e.g., by at least somewhat masking any asymmetrics that are observable in the final assembly due to the offset between the shaft adapter interior and exterior cylindrical surfaces (e.g., if the gap between the locking nut and the club head retaining portion is not constant around the entire perimeter). Additionally or alternatively, the spacer element 1100 may help keep water, moisture, dirt and other debris from entering the overall connection structure. Any desired shape or wall construction may be provided for the spacer element 1100 without departing from this invention, and it may be made in any desired manner, such as via injection molding or other molding processes.

C. General Description of the Orientation Marker

In some aspects, a golf club may have an orientation marker that provides information concerning the relative orientation between the golf club head and the shaft. The orientation marker may be located on the golf club, such as on the golf club head or the shaft. The orientation marker includes indicia or other suitable markings to distinguish relative club head/shaft orientations from one another. For example, for a golf club having two, three, four, five, six, seven, eight, or more predetermined club head/shaft orientations, the orientation marker may simply include numeric indicia (e.g., 1, 2, 3, . . .) to designate each of the predetermined club head/shaft orientations.

The indicia or other markings of the orientation marker may be in various other forms, such as alphanumeric indicia, colors, symbols, or a combination of alphanumeric indicia, numeric indicia, colors, and symbols. FIGS. 12A through 12E illustrate an example cover element 1200 or ferrule having indicia 1202 on its exterior surface 1204 to provide an indication of the orientation of the shaft 106 with respect to the club head retaining structure. The cover element 1200 may be structured, with certain asymmetries in some instances, to allow it to slide over and cover the end of the shaft that protrudes from the club head retaining structure at an angle. The indicia 1202 may include, e.g., the designation "L" to indicate a draw bias (and a closed club face configuration), the designation "R" to indicate a fade bias (and an open club face configuration), the down arrow to indicate a lower trajectory face angle, and the up arrow to indicate a higher trajectory face angle, etc. The indicia 1202 may be arranged on the cover element 1200 so that the indicia facing the user in the address position corresponds to the club head setting. As another example, the indicia 1202 may be arranged on the cover element 1200 so that the indicia aligns with additional indicia provided on the club head retaining element or the hosel, to provide shaft/club head orientation information. The indicia may also be color coded. For example, the upward arrow 1202 may be colored yellow to designate a neutral and flat orientation.

D. General Description of the Key Member

In some aspects, a key member provides additional information with respect to one or more of the available relative club head/shaft orientations. The key member may be located, for example, on the golf club head, shaft, or grip portion, or on a head cover for the club head. The key member contains graphics, indicia, and/or other markings that convey information with respect to the club head/shaft orientation. For example, the key member may include a graphical depiction of ball flight, alphanumeric indicia, colors, symbols, or any combination thereof.

Figure 13:
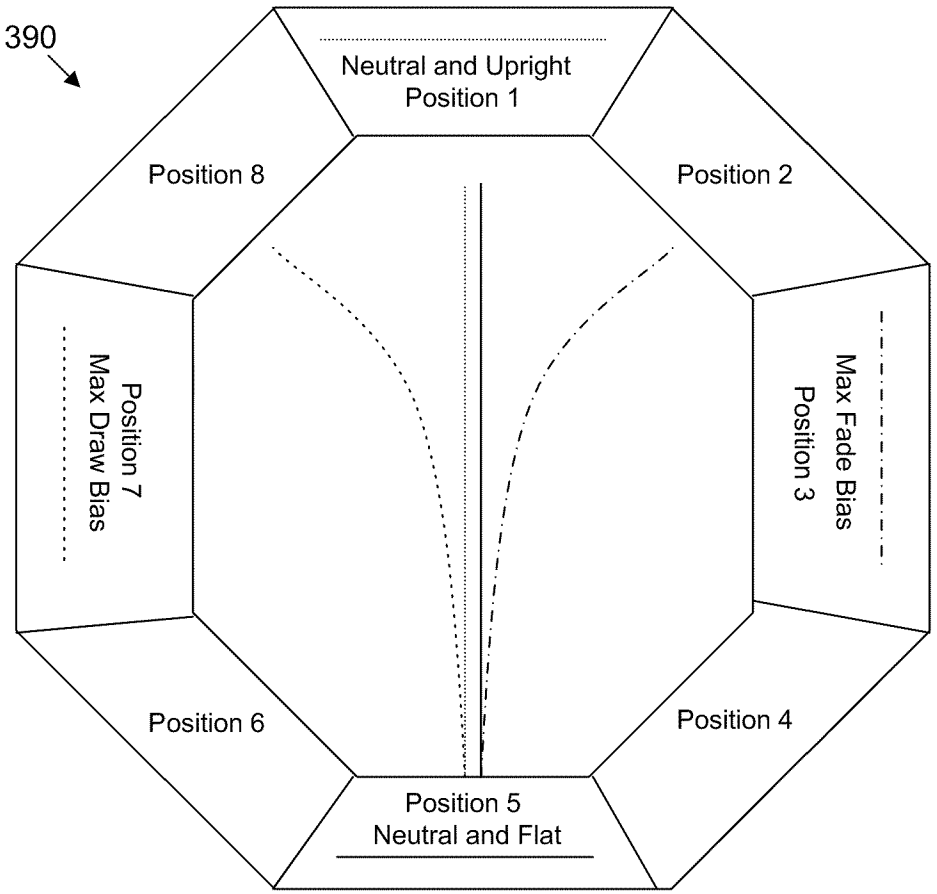
FIG. 13 illustrates an example of a key member which provides information with respect a plurality of relative orientations between the golf club head and the shaft.

FIG. 13 illustrates an example of a key member in the form of a medallion 390 that may be affixed onto the end of the grip portion of a golf club. In this example, the medallion is octagon-shaped with the periphery thereof divided into eight sections corresponding to eight predetermined club head/shaft orientations. Each section includes indicia representing a given orientation (e.g., "Position 1," "Position 2," etc.) and/or alphanumeric indicia describing the predicted ball flight for that orientation ("Neutral and Flat," "Max Draw Bias," etc.). In addition, the center of the medallion 390 includes a graphical representation showing the predicted ball flight for some or all of the orientations. In FIG. 13, several different predicted ball flights are shown using distinctive solid or dashed lines for purposes of illustration. In practice, the outer sections of the key member 390 may be color coded to match corresponding lines included in the graphical display. A small magnifying glass may be provided, for example, in a pocket located on a golf club head cover, to assist the user in reading the indicia on the key member 390.

Figure 14:
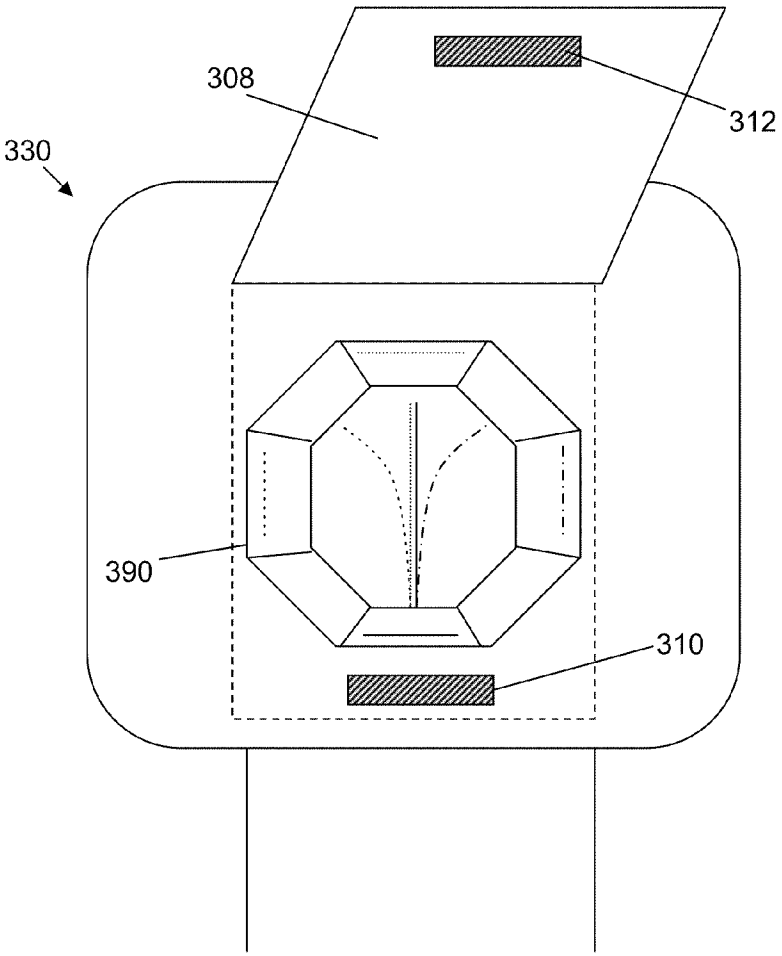
FIG. 14 illustrates an example of a key member affixed to a golf club head cover.

FIG. 14 schematically illustrates an example of a key member 390 affixed to a golf club head cover 330. The key member may be affixed by any suitable technique such as lamination with or without adhesive, stitching, and the like. A flap 308 optionally may be provided to selectively cover and uncover the key member 390. The end of the flap 308 may have a suitable fastener 312 to hold the flap 308 against a corresponding fastener element 310 on the head cover 330. Fasteners 310 and 312 may be of any suitable type, such as hook and loop type fasteners (e.g., VELCRO™), magnetic, or the like.

Figure 15:
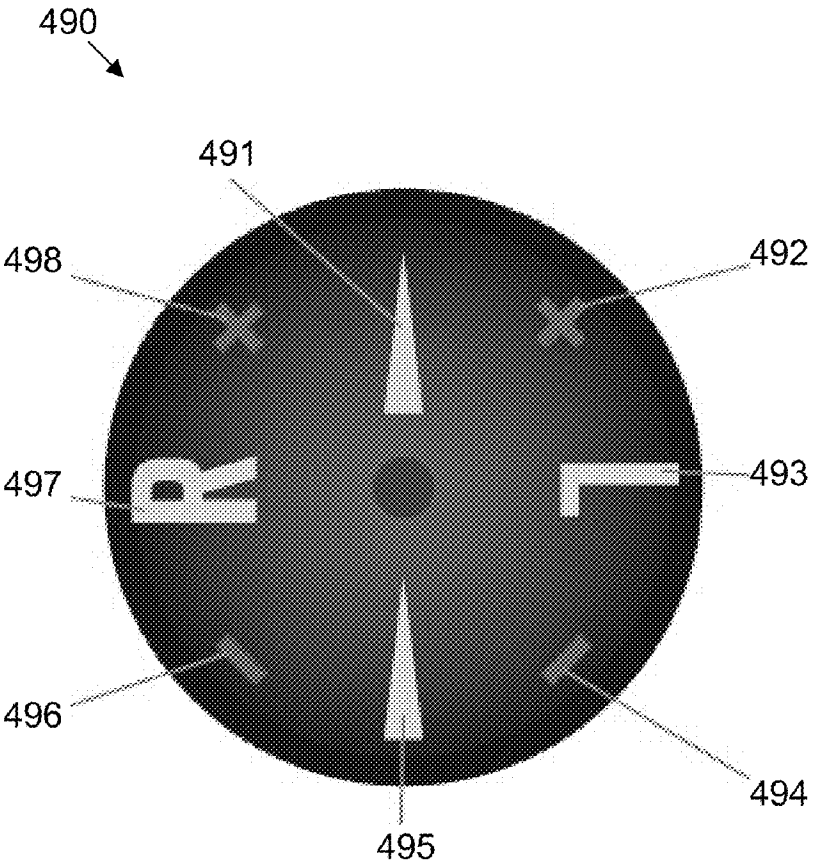
FIG. 15 illustrates another example of a key member, which may be affixed to a golf club grip or a golf club head cover.

FIG. 15 illustrates another example of a key member 490. The key member 490 may be generally circular and dimensioned, for example, to allow it to be affixed to the end of the grip portion of a golf club. Alternatively, the key member 490 may be dimensioned to allow it to be affixed to a golf club head cover, e.g., in a manner similar to that described above with respect to the key member 390 in FIG. 14. The key member 490 may include indicia such as "L" 493 to indicate a draw bias (and a closed club face configuration), "R" 497 to indicate a fade bias (and an open club face configuration), a down arrow 495 to indicate a lower trajectory face angle, and an up arrow 491 to indicate a higher trajectory face angle. Additional indicia, such as plus signs (+) 492 and 498 and minus signs (−) 494 and 496, may be used to designate intermediate orientations. The key member 490 may be affixed to a golf club grip, head cover, or other surface so that it may be repositioned to allow the appropriate indicia (e.g., 491, 492, 493, etc.) to be aligned with a reference point according to the selected head/shaft orientation. This way, a golfer is able to conveniently glean information about the head/shaft orientation from the golf club head cover or golf club grip (via the key member 490 affixed thereto), which in some cases may avoid the need for removing a head cover from the golf club or removing the golf club from a golf bag in order to determined the head/shaft orientation. The indicia may also be color-coded. For example, the upward arrow 491 may be colored yellow to designate a neutral and flat orientation; the down arrow 495 may be colored silver; and so on.

In addition to indicia on the key member being color-coded as described above, the key member itself may be color-coded to indicate other characteristics of the golf club, such as shaft flex characteristics. For example, key members 490 having a yellow background may be used to identify shafts having a moderate balance between butt and tip stiffness. Such shafts typically are neutral with respect to ball flight characteristics. Key members 490 having a red background may be used to identify shafts having a relatively stiff tip section, which generally produce a lower ball flight and less spin by delivering the club head with less lead at impact. Key members 490 having a green background may be used to identify shafts that have a relatively weaker or softer tip section. Such shafts typically promote a higher ball flight by delivering the club with more lead at impact (more loft), and generally increase spin. In addition to color coding, the key member 490 may include other indicia to provide additional information on the butt and/or tip stiffness, such as numeric designations.

Instead of or in addition to a key member having graphical indicia as described above, the key member may be in the form of a table or the like. Such a key member may be affixed to or otherwise provided on the shaft, grip portion, or club head of a golf club, or affixed to or otherwise provided on a golf club head cover. An example of a tabular key member is shown below. Each row (corresponding to a different relative club head/shaft orientation) may have a background with a distinctive color. The background color may correspond to the colors used in the medallion 390 and/or the orientation marker as discussed above.

| | Description | | | Measured | | | |
|---|---|---|---|---|---|---|---|
| Position | Orientation | Face Angle | Lie Angle | Loft | Face Angle | Lie | Effective Loft |
| 1 | Neutral and Upright | Square | Upright | 10.5 | 0 | 62 | 10.5 |
| 2 | | Open | Upright | 10.5 | 1 | 61 | 9.5 |
| 3 | Max Fade Bias | Open | Neutral | 10.5 | 2 | 60 | 8.5 |
| 4 | | Open | Flat | 10.5 | 1 | 59 | 9.5 |
| 5 | Neutral and Flat | Square | Flat | 10.5 | 0 | 58 | 10.5 |
| 6 | | Closed | Flat | 10.5 | −1 | 59 | 11.5 |
| 7 | Max Draw Bias | Closed | Neutral | 10.5 | −2 | 60 | 12.5 |
| 8 | | Closed | Upright | 10.5 | −1 | 61 | 11.5 |

While the invention has been described in detail in terms of specific examples including presently preferred modes of carrying out the invention, those skilled in the art will appreciate that there are numerous variations and permutations of the above described systems and methods. Thus, the spirit and scope of the invention should be construed broadly as set forth in the appended claims.

We claim:

1. A golf club comprising: a shaft; a golf club head;

an orientation marker located on the golf club shaft that indicates at least a relative orientation between the golf club head and the shaft; and a key member independent of the orientation marker that provides additional information with respect to the relative orientation between the golf club head and the shaft, wherein the key member is affixed to the golf club head.

2. The golf club of claim 1 wherein the orientation marker comprises color-coded indicia.

3. The golf club of claim 1 wherein the key member comprises color-coded indicia.

4. The golf club of claim 1 wherein the key member is color-coded to provide information with respect to one or more flex characteristics of the shaft.

* * * * *